US005728003A

United States Patent [19]

Hustad

[11] Patent Number: 5,728,003

[45] Date of Patent: Mar. 17, 1998

[54] PRESSURE POINT DEVICE

[76] Inventor: Gregory B. Hustad, 403 - 18th Ave., Kirkland, Wash. 98033

[21] Appl. No.: 703,656

[22] Filed: Aug. 27, 1996

[51] Int. Cl.[6] ..... F41B 15/02

[52] U.S. Cl. ..... 463/47.2; 463/47.7; 362/102

[58] Field of Search ..... 463/47.2, 47.4, 463/47.6, 47.7; 362/102; D8/378

[56] References Cited

U.S. PATENT DOCUMENTS

| | | | |
|---|---|---|---|
| D. 74,359 | 2/1928 | Crawford | D8/378 |
| D. 80,719 | 3/1930 | Blake | D8/378 |
| D. 340,404 | 10/1993 | Prezner | D8/378 |
| 3,106,398 | 10/1963 | Gowdey . | |
| 5,108,097 | 4/1992 | Ashihara . | |
| 5,188,362 | 2/1993 | Ashihara . | |
| 5,287,255 | 2/1994 | Strodtman . | |
| 5,320,349 | 6/1994 | Winston . | |
| 5,356,139 | 10/1994 | Parsons . | |
| 5,363,285 | 11/1994 | Wideman . | |
| 5,509,653 | 4/1996 | Parsons . | |

*Primary Examiner*—William M. Pierce
*Attorney, Agent, or Firm*—Steven P. Koda

[57] ABSTRACT

A pressure point device is formed by an end piece attached to a baton or flashlight. The end piece defines two pressure point surfaces. A first pressure point surface is defined by a bulbous tip of the end piece. The tip extends longitudinally along the axis of the baton or flashlight. A second pressure point surface is defined by a shoulder of the end piece. The shoulder has a larger diameter than the baton or flashlight in the region where attached. Thus, the shoulder protrudes radially defining an effective pressure point surface. The presence of shoulder with the bulbous tip increases the range of positions for holding the baton or flashlight while applying force to a pressure point.

21 Claims, 2 Drawing Sheets

PRESSURE POINT DEVICE

BACKGROUND OF THE INVENTION

This invention relates to personal protective devices and weapons, and more particularly to flashlights and batons serving as protective devices or weapons.

Although many law enforcement or security personnel often carry fire arms, many of such personnel typically carry non-firing weapons such as a baton. A common type of baton, called a night stick or billy club, is a rigid elongated club made of wood, metal or another sturdy material. The baton is used either offensively to disarm or subdue an assailant, or defensively to as a protective device. Heavy duty flashlights having a metal casing also are used in a similar fashion. The flashlight provides a versatile choice functioning both as a flashlight and as a protective device.

When a law enforcement or security officer subdues an assailant it is desirable to perform the task quickly and effectively so as to eliminate any potential harm to the officer, a victim or any other persons or objects in the vicinity. In the use of reasonable force to subdue the assailant it also is preferable perform the task without harming or with minimal harm to the assailant. One effective technique of restraining an assailant is to apply force to a bodily pressure point. The use of force at bodily pressure points is common in martial arts and is typically taught to law enforcement officials. Applying force at a pressure point enacts a great deal of pain with use of little force, and without permanent injury. Such pain typically renders a person incapable of fighting back while the force is applied.

SUMMARY OF THE INVENTION

According to the invention, a pressure point device is formed by attaching a pressure point end piece to a baton or heavy duty flashlight. According to one aspect of the invention, the end piece defines two pressure point surfaces. A first pressure point surface is defined by a tip of the end piece. A bulbous tip portion of the end piece extends longitudinally along the axis of the baton or flashlight. A second pressure point surface is defined by a shoulder portion of the end piece. Typically the baton or flashlight extends cylindrically. The pressure point end piece is attached at one end. The shoulder portion is of wider diameter than the baton or flashlight in the vicinity of the connection. Thus, the second pressure point surface extends radially beyond the surface of the baton or flashlight.

One advantage of the second pressure point surface is that the resulting pressure point weapon combination is easier to apply, and thus more effective, over a greater range of positions. Specifically, the first pressure point surface is effective over a given first range of angled orientation of the baton or flashlight axis. For example, a straight on axial orientation translates a force applied by the enforcement officer most directly to the assailant. In the action of restraining an assailant, however, an officer may find the baton at any of various positions. The presence of the second pressure point surface enables the pressure point device to be applied even when the baton of flashlight is turned sideways in parallel to the assailant's body. Thus, the pressure point device is effective over a range including a straight-on orientation through at least plus or minus 90 degrees from such straight-on orientation. A beneficial effect of such range is that the length of the baton or flashlight can be used to hold an assailant down, while the shoulder portion of the pressure point end piece is applied to a pressure point. Another advantage of the invention is that the shoulder allows a baton embodiment to be secured in a holster loop, as opposed to a full body holster. The baton is easier to draw from the holster loop. Another advantage is that for a collapsed baton embodiment the shoulder serves to identify the orientation of the baton. For example, a collapsed baton conventionally is cylindrical. During a straggle, should the baton fall to the ground it is difficult for a user grabbing the baton to readily know which end is forward. The shoulder provides a ready feel identifying which end is forward. The user then extends the baton to serve as a night stick and/or applies the end piece end to a pressure point. Another advantage of the invention is that the baton or flashlight is effective to escort a person in custody where, for whatever reason, handcuffs are not used. By applying the shoulder and end tip to one's wrist such person is readily restrained, and thus able to be escorted. These and other aspects and advantages of the invention will be better understood by reference to the following detailed description taken in conjunction with the accompanying drawings.

DESCRIPTION OF SPECIFIC EMBODIMENTS

Pressure Point End Piece

Figure 1:
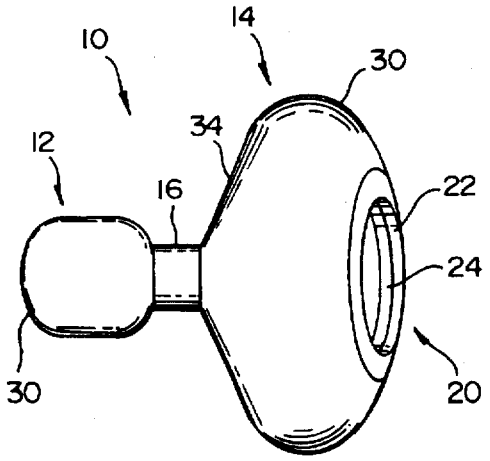
FIG. 1 is a perspective view of the pressure point end piece according to an embodiment of this invention.
Figure 2:
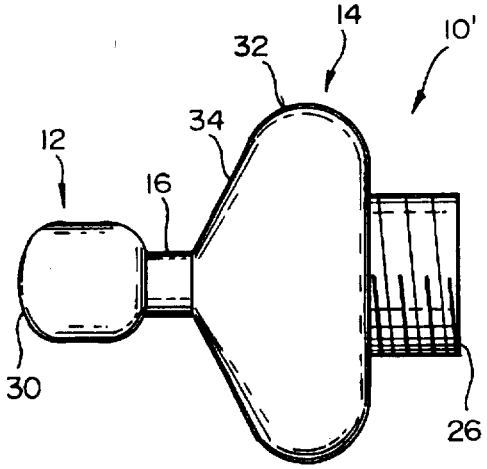
FIG. 2 is a perspective view of the pressure point end piece according to another embodiment of this invention.

FIG. 1 shows an end piece 10 for being attached to a baton, flashlight or other elongated member 11. The end piece 10 defines a bulbous end 12, a base 14 and an intermediary shaft 16. The end piece 10 screws on or otherwise attaches or mates with an end portion 18 of the elongated member 11. In one embodiment the end piece 10 defines an opening 20 into which the end portion 18 of the member 11 is received. Female threads 22 are defined along a surface 24 of the end piece 10 which defines the opening 20. In an alternative embodiment an end piece 10' (see FIG. 2), instead defines a threaded male shaft 26 adjacent to the shoulder 14 in place of the female opening 20. For such alternative embodiment the end piece 10' screws into a female opening of an elongated member 11'. The size and dimensions of the bulbous end 12, base 14 and intermediary shaft 16 need not vary whether a female opening 20 or a male shaft 26 is included. The size and dimensions of the bulbous end 12, base 14 and intermediary shaft 16, however, does vary according to alternative embodiments.

The bulbous end 12 serves as a first surface for applying pressure to a person's pressure point. In one embodiment the bulbous end 12 defines a blunt, rounded distal surface 30. In an exemplary embodiment the bulbous end 12 extends axially approximately 1.5 cm and has a cross-sectional diameter of approximately 1.5 cm. Preferably the bulbous end 12 has a distal surface 30 small enough to apply directly to an individual's pressure point. Too large of a surface spreads the force over an area beyond the pressure point.

Accordingly, the cross sectional diameter of the bulbous end 12 preferably is less than 2.0 cm. Also, the bulbous end 12 preferably has a cross section which is smaller than the cross section of the elongated member 11 at a portion of the elongated member 11 adjacent to the end piece 10.

Figure 4:
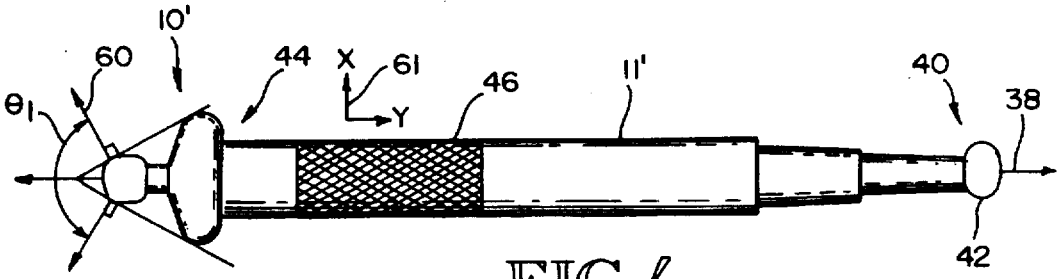
FIG. 4 is a planar view of a pressure point weapon according to one embodiment of this invention.
Figure 5:
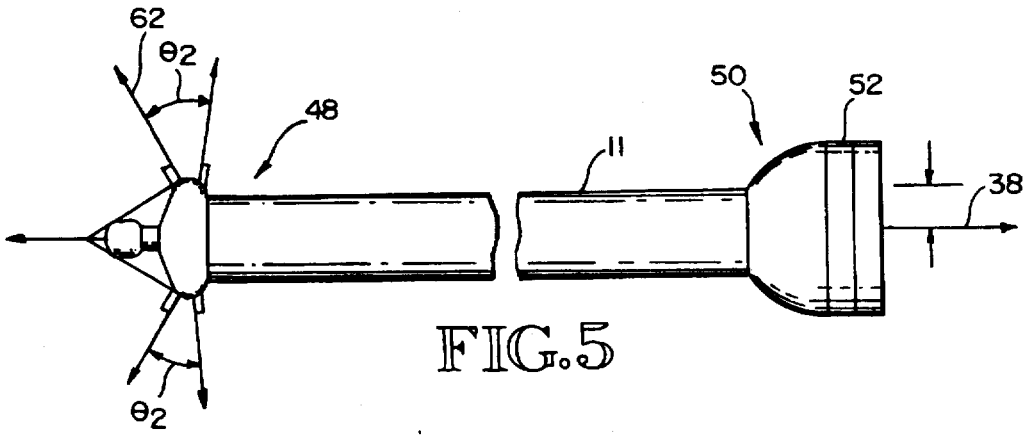
FIG. 5 is a planar view of a pressure point weapon according to another embodiment of this invention.

The base 14 includes a threaded male or female region for attaching to an elongated member 11, 11'. In one embodiment the female opening 20 occurs within the base 14. In another embodiment the male shaft 26 extends axially from the base 14. The base 14 defines a shoulder 32 which serves as a second surface for applying pressure to a person's pressure point. Preferably the shoulder 32 defines a rounded surface along a longitudinal direction 38 (relative to the elongated member 11, 11'). Referring to FIGS. 4 and 5, the shoulder 32 protrudes radially relative to the elongated member 11, 11'. The shoulder 32 is symmetrical occurring along an entire circumference of the end piece 10, 10'. In an exemplary embodiment the base 14 extends longitudinally for 2.5 cm (excluding male shaft 26). Preferably the shoulder 32 has a contact surface small enough to apply force directly to an individual's pressure point. Accordingly, the contact surface of the shoulder preferably is less than 2.0 cm along the axial direction 38 (see FIG. 4). Too large of a surface spreads the force over an area beyond the pressure point reducing the effect of pressure.

Between the bulbous end 12 and base 14 is an intermediary shaft 16. Preferably, the shaft 16 is cylindrical extending parallel to the elongated member 11, 11' axis 38. The shaft 16 separates the bulbous end 12 from the base 14. The base 14 defines an inclined surface 34 extending at an angle from the intermediary shaft 16 to the shoulder 32. In an exemplary embodiment the shaft 16 extends longitudinally for 0.7 cm and has a diameter of approximately 0.8 cm. In alternative embodiments the shaft is omitted or is tapered along its length.

Pressure Point Weapon

Figure 3:
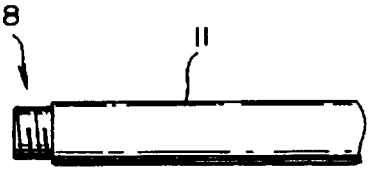
FIG. 3 is a planar view of an end portion of an elongated cylinder for receiving the end piece of FIG. 1.

FIGS. 4 and 5 show preferred embodiments for a pressure point weapon. In one embodiment a baton 11' (e.g., a telescoping night stick; fixed length night stick or other elongated member) receives the end piece 10'. The baton 11' is an elongated member extending in a longitudinal direction 38. The baton includes a first end 40 defining a first blunt end tip 42. At an opposite end 44 the baton 11' defines a female opening (not shown) for receiving the threaded male shaft 26 of the end piece 10'. As shown in FIG. 4, the first end 40 is contoured differently than the opposite end 44 and differently than the end piece 10'. In an alternative embodiment the baton has a threaded male shaft (see FIG. 3) which screws into the female opening 20 of the end piece 10. In some embodiments the baton 11' includes a hand grip area 46. During use an officer typically holds the baton 11' at the hand grip area 46 and jabs forward thrusting the first tip 42 toward the assailant or draws the baton backward moving the bulbous end 12 of the end piece 10' toward the assailant. An advantage of the end piece 10, 10' is that the baton 11' can be applied to an assailant using either end 40, 44 of the weapon.

FIG. 5 shows an alternative embodiment in which the end piece 10 is attached to a flashlight 11. The flashlight 11 extends in a longitudinal direction 38 and has a first end 50 where a light 52 is operative. At an opposite end 48 the flashlight 11 defines a threaded male shaft 18 (see FIG. 3) which screws into the female opening 20 of the end piece 10. In an alternative embodiment the flashlight ' defines a female opening (not shown) for receiving the threaded male shaft 26 of the end piece 10'. The end piece 10, 10' enables the flashlight to be used effectively as a protective weapon in subduing an assailant or as an offensive weapon in restraining an assailant.

Applying Force to Assailant

The end piece 10, 10' defines two pressure point surfaces—one at the bulbous tip 12 and a second at the shoulder 32. In use either one or both of the bulbous tip 12 and the shoulder 32 is pressed against a pressure point of an assailant or other individual to apply a force. Referring to FIG. 4, the direction of a normal (i.e., perpendicular) force component applied by the bulbous tip 12 occurs as any normal vector 60 within the arc $\theta_1$. In a preferred embodiment the arc $\theta_1$ of normal vectors is as great as 120° along any plane passing through the axis 38 of the baton 11' or flashlight 11. The arc $\theta_1$ is shown transposed onto a two-dimensional plane 61 of the drawing sheet. Such arc $\theta_1$ is centered at the longitudinal axis 38 extending ±60° within the plane 61 or any other such plane passing through the axis 38. A 120° arc occurs for an embodiment in which an angle off the axis 38 tangent to bulbous tip 12 and shoulder 32 is 30°. Although the arc $\theta_1$ is depicted within the two-dimensional plane 61 applied forces 60 also have a third dimensional (e.g., z) component.

Referring to FIG. 5, the direction of a normal force component applied by the shoulder 32 to an assailant occurs as any normal force vector component 62 within arc $\theta_2$. The limits of arc $\theta_2$ are defined by the bulbous tip 12 at one end and the flashlight end 50 (or baton tip end 40). Thus, the range of normal vectors 62 within arc $\theta_2$ commence at the limit of the range defined by the arc $\theta_1$. The limit at the bulbous end 12 is defined by all tangent lines from bulbous tip 12 to shoulder 32. The limit at the other end of the arc $\theta_2$ is defined by all tangent lines from the shoulder 32 to flashlight end 50 (or baton end 40). The arcs $\theta_2$ extend the range for the application of forces (e.g., normal force components) to an assailant to the arc $\theta_1+2\theta_2$. For an exemplary embodiment the arc $\theta_2$ extends the application of normal force components by 45° on each side of arc $\theta_1$. For such embodiment the range is approximately 210°. Accordingly, the shoulder 32 allows the pressure point weapon to be applied over a greater range of positions. The pressure point weapon 11, 11' can be oriented at any position over more than a 270° arc of any plane passing through the axis 38. Of particular significance, the pressure point weapon can apply a force perpendicular to the axis of the baton 11' or flashlight 11.

Figure 6:
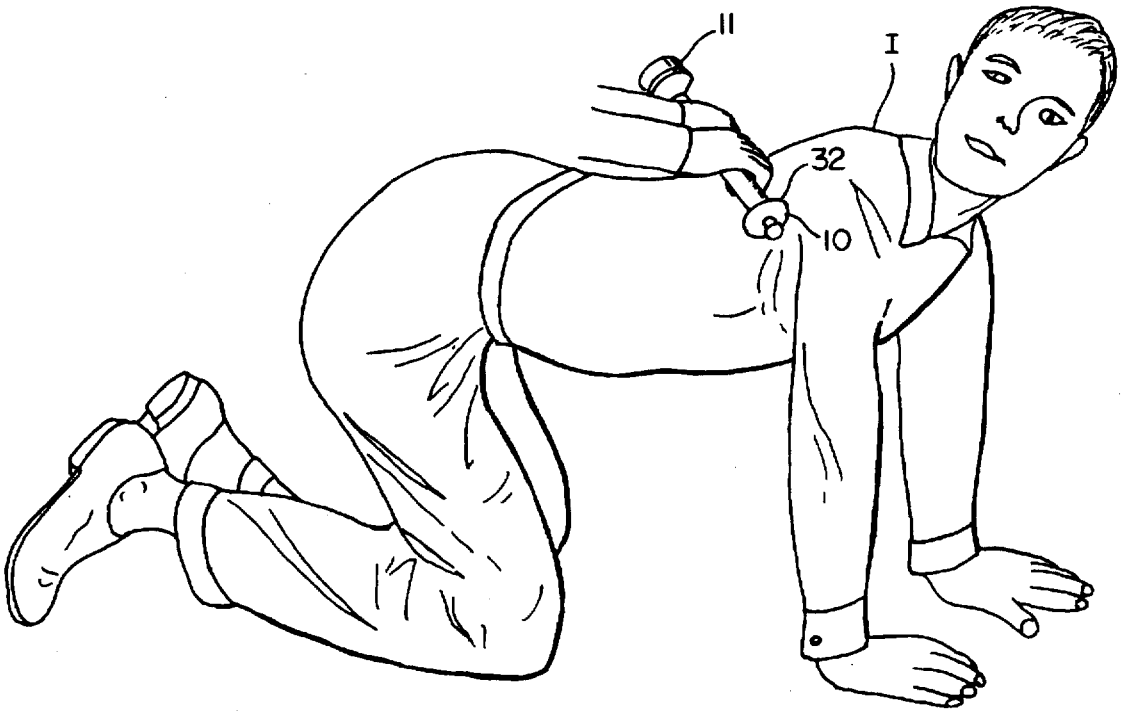
FIG. 6 is a perspective view of an assailant being subdued by the pressure point weapon of FIG. 5.

The advantage of applying a force perpendicular to the axis 38 is illustrated by the orientation of the flashlight 11 shown in FIG. 6. An enforcement officer holds an assailant down by applying the flashlight 11 along its length against the back of an individual I. By making contact with the assailant across the assailant's back the officer has better control of the assailant. By applying the shoulder 32 to the assailant's back at a pressure point, the assailant in addition is effectively subdued. Without the shoulder 32 more of a jabbing or axial force would have to be applied to contact a pressure point. In such position, however, it would be more difficult to hold the individual down using the rest of the flashlight. Accordingly, the presence of the shoulder 32 and the bulbous end 12 allows application of force to a pressure point from a greater range of position.

The shoulder 32 also serves as a fulcrum for applying pressure with the bulbous end 30. Using one or both hands a user can hold the shoulder to an assailant's wrist or other body part and roll the elongated member 11,11' to apply force with the end 30. Use of a fulcrum enables the user to conveniently apply more pressure to the assailant.

One advantage of the end piece 10, 10' is that a conventional telescoping night stick is converted into a pressure point weapon. The night stick conventionally is used as a striking weapon. Typically, the night stick is too long to serve as an effective pressure point weapon. The tip typically is blunted to prevent penetration. When collapsed the blunted tip typically is flush with the encasing gripping portion. By attaching the end piece 10, 10' to the opposite end of the night stick, the opposite end is able to be used as a pressure point weapon. In addition, when using the night stick in its conventional manner, the shoulder aids the gripping and control of the night stick. One particular benefit is that the shoulder makes it more difficult for an assailant to pull the night stick from a user. The shoulder serves as a stop preventing or at least blocking the night stick from sliding through the user's grasp. In addition, when an assailant grabs the night stick, the user can rotate the stick around while the both hold the night stick and apply the end tip 10, 10' to the assailant's torso.

Although a preferred embodiment of the invention has been illustrated and described, various alternatives, modifications and equivalents may be used. For example, in an alternative embodiment the end piece 10 is formed integrally at a given end 44, 48 of the baton 11' or flashlight 11. Therefore, the foregoing description should not be taken as limiting the scope of the inventions which are defined by the appended claims.

What is claimed is:

1. A pressure point apparatus for applying force to a pressure point of an individual, comprising:

a baton having an elongated shaft extending in an axial direction, the baton having a first end and a second end, the shaft defining a first cross sectional length at the baton first end perpendicular to the axial direction; and an end piece removably attached to the first end, the end piece comprising: (a) a bulbous end having a first contact surface for applying force to a pressure point, the bulbous end positioned distally away from the elongated shaft, and (b) a base having a shoulder portion, the shoulder portion having a second contact surface for applying force to a pressure point, and wherein the first contact surface and second contact surface are separated by an intermediary surface of the end piece, and wherein the base defines a second cross-sectional length greater than the first cross-sectional length so that the shoulder portion protrudes radially beyond the first end; and wherein the baton second end has a blunt tip and wherein the second end differs in contour from the end piece.

2. The apparatus of claim 1, in which the baton is a telescoping night stick.

3. The apparatus of claim 1, in which the end piece further comprises an intermediary shaft between the bulbous end and the base, the intermediary surface comprising a surface of the intermediary shaft.

4. The apparatus of claim 1, further comprising an intermediary shaft between the bulbous end and the base, wherein the intermediary surface comprises a surface of the intermediary shaft and a surface of the base adjacent to the second contact surface.

5. The apparatus of claim 1, in which the second contact surface spans not more than 2 cm in an axial direction relative to the elongated shaft.

6. The apparatus of claim 1, in which the bulbous end extends radially relative to the elongated shaft for a length less than the first cross sectional length.

7. A pressure point apparatus for applying force to a pressure point of an individual, comprising:

a baton having an elongated shaft extending in an axial direction, the baton having a first end and a second end, wherein the shaft defines a first cross sectional length at the first end perpendicular to the axial direction; and a bulbous tip distally positioned at the baton first end, the bulbous tip defining a first contact surface for applying force to a pressure point;

a shoulder at the baton first end defining a second contact surface for applying force to a pressure point, wherein the first contact surface and second contact surface are separated by an intermediary surface, and wherein the shoulder defines a second cross-sectional length greater than the first cross-sectional length so that the shoulder protrudes radially farther than the shaft; and wherein the second end has a blunt tip and wherein the second end differs in contour from the first end and lacks a shoulder.

8. The apparatus of claim 7, in which the baton is a telescoping night stick.

9. The apparatus of claim 7, further comprising an intermediary shaft between the bulbous end and the shoulder, the intermediary surface comprising a surface of the intermediary shaft.

10. The apparatus of claim 7, in which the second contact surface spans not more than 2 cm in an axial direction.

11. The apparatus of claim 7, in which the bulbous tip extends radially relative to the elongated shaft for a length less than the first cross sectional length.

12. A pressure point apparatus for applying force to a pressure point of an individual, comprising:

a baton having an elongated shaft extending in an axial direction, the baton having a first end and a second end, wherein the shaft defines a first cross sectional length at the first end perpendicular to the axial direction; and means for contacting a pressure point in response to a force applied via the baton, the contacting means located at the baton first end, the contacting means comprising a bulbous tip, a shoulder, and an intermediary surface between the bulbous tip and shoulder, the bulbous tip distally positioned at the baton first end and defining a first contact surface, the shoulder defining a second contact surface and having a second cross-sectional length greater than the shaft first cross-sectional length so that the shoulder protrudes radially farther than the shaft; and wherein the baton second end has a blunt tip and wherein the second end differs in contour from the contacting means.

13. A pressure point apparatus for applying force to a pressure point of an individual, comprising:

a flashlight having an elongated shaft extending in an axial direction and having a first end, wherein the shaft defines a first cross sectional length at the first end perpendicular to the axial direction; and an end piece removably attached to the first end of the elongated shaft, the end piece comprising: (a) a bulbous end defining a first contact surface for applying force to a pressure point, the bulbous end positioned distally away from the elongated shaft, and (b) a base having a shoulder portion defining a second contact surface for applying force to a pressure point, wherein the first contact surface and second contact surface are separated by an intermediary surface of the end piece, and wherein the base defines a second cross-sectional length greater than the first cross-sectional length so that the shoulder portion protrudes radially beyond the first end.

14. The apparatus of claim 13, in which the end piece further comprises an intermediary shaft between the bulbous end and the base, the intermediary surface comprising a surface of the intermediary shaft.

15. The apparatus of claim 13, further comprising an intermediary shaft between the bulbous end and the base, wherein the intermediary surface comprises a surface of the intermediary shaft and a surface of the base adjacent to the second contact surface.

16. The apparatus of claim 13, in which the second contact surface spans not more than 2 cm in an axial direction relative to the elongated shaft.

17. The apparatus of claim 13, in which the bulbous end extends radially relative to the elongated shaft for a length less than the first cross sectional length.

18. A pressure point apparatus for applying force to a pressure point of an individual, comprising:

a flashlight having an elongated shaft extending in an axial direction and having a first end, wherein the shaft defines a first cross sectional length at the first end perpendicular to the axial direction; and a bulbous tip distally positioned at the first end of the elongated shaft end, the bulbous tip defining a first contact surface for applying force to a pressure point;

a shoulder at the first end of the elongated shaft defining a second contact surface for applying force to a pressure point, wherein the first contact surface and second contact surface are separated by an intermediary surface, and wherein the shoulder defines a second cross-sectional length greater than the first cross-sectional length so that the shoulder protrudes radially.

19. The apparatus of claim 18, further comprising an intermediary shaft between the bulbous tip and the shoulder, the intermediary surface comprising a surface of the intermediary shaft.

20. The apparatus of claim 18, in which the second contact surface spans not more than 2 cm in an axial direction.

21. The apparatus of claim 18, in which the bulbous tip extends radially relative to the elongated shaft for a length less than the first cross sectional length.

* * * * *